US005480245A

United States Patent [19]

Martin

[11] Patent Number: 5,480,245

[45] Date of Patent: Jan. 2, 1996

[54] GAMING DEVICE WITH AN IMPROVED PAPER SUPPLY SYSTEM

[75] Inventor: John R. Martin, Rockford, Ill.

[73] Assignee: Arachnid, Inc., Rockford, Ill.

[21] Appl. No.: 853,106

[22] Filed: Mar. 18, 1992

[51] Int. Cl.[6] ..... B41J 15/18

[52] U.S. Cl. ..... 400/613.2; 400/606; 400/607; 226/200

[58] Field of Search ..... 226/200; 400/606, 400/609, 610, 613, 613.1, 613.2, 605, 607, 611, 613.3; 364/479, 412

[56] References Cited

U.S. PATENT DOCUMENTS

| | | | |
|---|---|---|---|
| 1,675,436 | 7/1928 | Waldheim | 400/613.2 |
| 2,369,441 | 2/1945 | Daly et al. | 400/606 |
| 2,854,116 | 9/1958 | Gray | 400/60 |
| 3,283,874 | 11/1966 | Goreham | 400/606 |
| 3,939,955 | 2/1976 | Menzi | 400/613.2 |
| 4,059,256 | 11/1977 | Palmer | 400/606 X |
| 4,515,490 | 5/1985 | Marker, III | 400/613.2 |
| 4,722,623 | 2/1988 | Kikuchi et al. | 400/607 |
| 4,895,466 | 1/1990 | Hartmann et al. | 400/613.2 |
| 4,982,337 | 1/1991 | Burr et al. | 364/479 |
| 5,080,236 | 1/1992 | Conner | 400/613.2 X |

FOREIGN PATENT DOCUMENTS

| | | | |
|---|---|---|---|
| 2560822 | 9/1985 | France | 400/613.2 |
| 0031718 | 3/1980 | Japan | 400/613.2 |
| 0039975 | 3/1982 | Japan | 400/606 |
| 0274970 | 12/1986 | Japan | 400/613.2 |

*Primary Examiner*—Chris A. Bennett

*Attorney, Agent, or Firm*—McAndrews, Held & Malloy, Ltd.

[57] ABSTRACT

A gaming device is shown having a controller that controls the operation of the gaming device and a printer that records events on paper in response to the controller. A first magazine is provided for holding fan folded paper to be input to the feed mechanism of the printer and a second magazine is positioned relative to the paper output of the printer to receive a printed record on at least a portion of the paper output from the printer. A third magazine is provided for holding a third supply of fan folded paper wherein an end of the paper in the first magazine is attached to an end of the paper held in the second magazine so that when paper in one magazine is depleted, paper in the other magazine is automatically input to the printer's input feed mechanism.

6 Claims, 2 Drawing Sheets

GAMING DEVICE WITH AN IMPROVED PAPER SUPPLY SYSTEM

TECHNICAL FIELD

The present invention relates to a gaming device having a printer for recording gaming events on paper and more particularly to an apparatus and method for minimizing the need to replenish paper in a gaming device and for maximizing the flexibility of timing paper replenishment.

BACKGROUND OF THE INVENTION

Gaming devices are known that include printers for recording various events on paper wound in a roll, the paper roll typically being mounted in the printer itself. Because the paper is mounted in the printer, the paper rolls employed are typically small requiring frequent replenishment which results in frequent interruption in the operation of the gaming device. Further, because the trailing end of the paper; i.e., the end on the inside of the roll is inaccessible, the time window within which a paper roll should ideally be replaced is very small. More particularly, the window for ideal paper replenishment is the time at which the paper roll becomes depleted. If the paper roll is replaced before it is completely depleted the paper remaining on the replaced roll is wasted. If the paper roll is not replaced soon after it is depleted, the down time of the gaming device increases. Further, if the paper roll is not replaced until it is completely depleted, the operator must make a special trip to the gaming device to replace the paper at times that may be inconvenient.

SUMMARY OF THE INVENTION

In accordance with the present invention, the disadvantages of prior paper supply systems for known gaming devices, as discussed above, have been overcome. The system of the present invention minimizes the need to replenish paper in a gaming device while maximizing the flexibility of timing paper replenishment.

More particularly, the gaming device of the present invention includes a controller for controlling the operations of the gaming device and a printer that records gaming events on paper in response to the controller. Instead of utilizing paper rolls mounted inside the printer, the gaming device of the present invention utilizes fan folded paper held in a first magazine that is positioned with respect to the printer so that an end of the fan folded paper may be input to the paper input feed mechanism of the printer. A second magazine is positioned relative to the paper output of the printer to receive at least a portion of the fan folded paper output from the printer. Because the gaming device of the present invention utilizes fan folded paper and the paper is fed to the printer from outside of the printer, the amount of paper capable of being continuously fed to the printer is much greater in the present gaming device than in prior gaming devices utilizing paper rolls.

In accordance with one embodiment of the present invention, a further magazine is provided for holding a second supply of fan folded paper to be input to the printer feed mechanism. A leading end of the paper in the further magazine is attached to the trailing end of the paper held in the first magazine so that when paper in the first magazine is depleted, paper in the further magazine is automatically input to the printer feed mechanism.

In accordance with the present invention both ends of the fan folded paper held in the input magazines are accessible. This allows the leading end of the paper held in the first magazine to be input to the printer feed mechanism and at any time prior to the depletion of the first magazine's paper, the trailing end of the first magazine's paper can be attached to the leading end of the fan folded paper held in the other input magazine. Thus, the time span when paper may be replenished begins when only one supply of paper remains, and ends when that supply is depleted so that the window of opportunity for paper replenishment is as long as it takes to use the paper held in one magazine. If the paper supply in one magazine is large enough, replenishment can be made to coincide with other visits to the gaming device. The present invention thus allows the operator to diminish the number of service trips to a given gaming device and further allows the operator to schedule the trips at his convenience.

These and other objects and advantages of the invention, as well as details of an illustrative embodiment, will be more fully understood from the following description and the drawings.

BEST MODE FOR CARRYING OUT THE INVENTION

Figure 1:
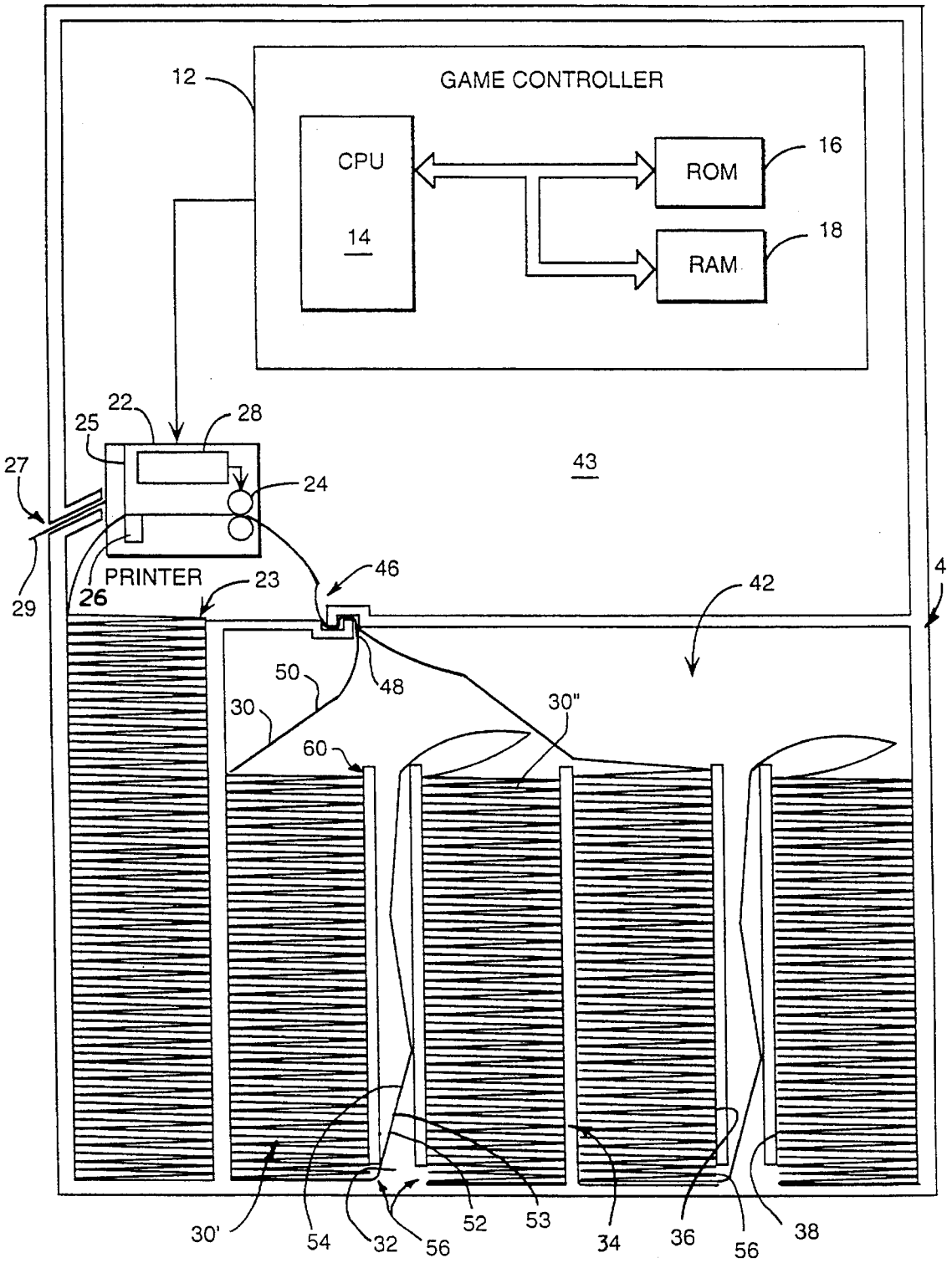
FIG. 1 is a perspective view of the inside of a gaming device cabinet illustrating one embodiment of the paper supply system of the present invention.

A gaming device 10 which employs the paper supply system of the present invention is shown in FIG. 1. The gaming device 10 includes a game controller 12 having a processor 14 coupled to a read only memory, ROM 16 and a random access memory, RAM 18 which respectively store software and data for controlling the operation of the gaming device. It is often desired to provide a record of various gaming events such as payouts on a win, the date and time of occurrence of a win, openings of a door on the gaming device's cabinet 20, etc. Therefore, in accordance with the present invention, the gaming device 10 includes a printer 22 that is controlled by the game controller 12 to print information on paper input to a paper feed mechanism 24 of the printer.

The printer 22 includes a conventional print head 26 for printing the information provided by the game controller 12 as a drive mechanism 28 controls the paper feed mechanism 24 to move the paper input to the printer 22 past the print head 26 at a controlled rate. The printer 22 also includes a separator, not shown, if double ply fan folded paper is employed to separate the top ply of paper from the bottom ply. The bottom ply paper falls or is directed into an output magazine 23 that is positioned with respect to the output of the printer 22 so that a physical record of gaming events can be maintained within the gaming device 10. The top ply of paper is cut by means of a knife or cutter 25 to produce a game event ticket 29 that is output from a slot 27 in the gaming device so that a player can redeem any winnings as shown on the ticket 29. It is noted that the printer 22 may include its own microprocessor which is responsive to information received from the game controller 12 to control the print head 26 and drive mechanism 28 or the game controller 12 may directly control the operations of the printer 22 as is well known.

Figure 2:
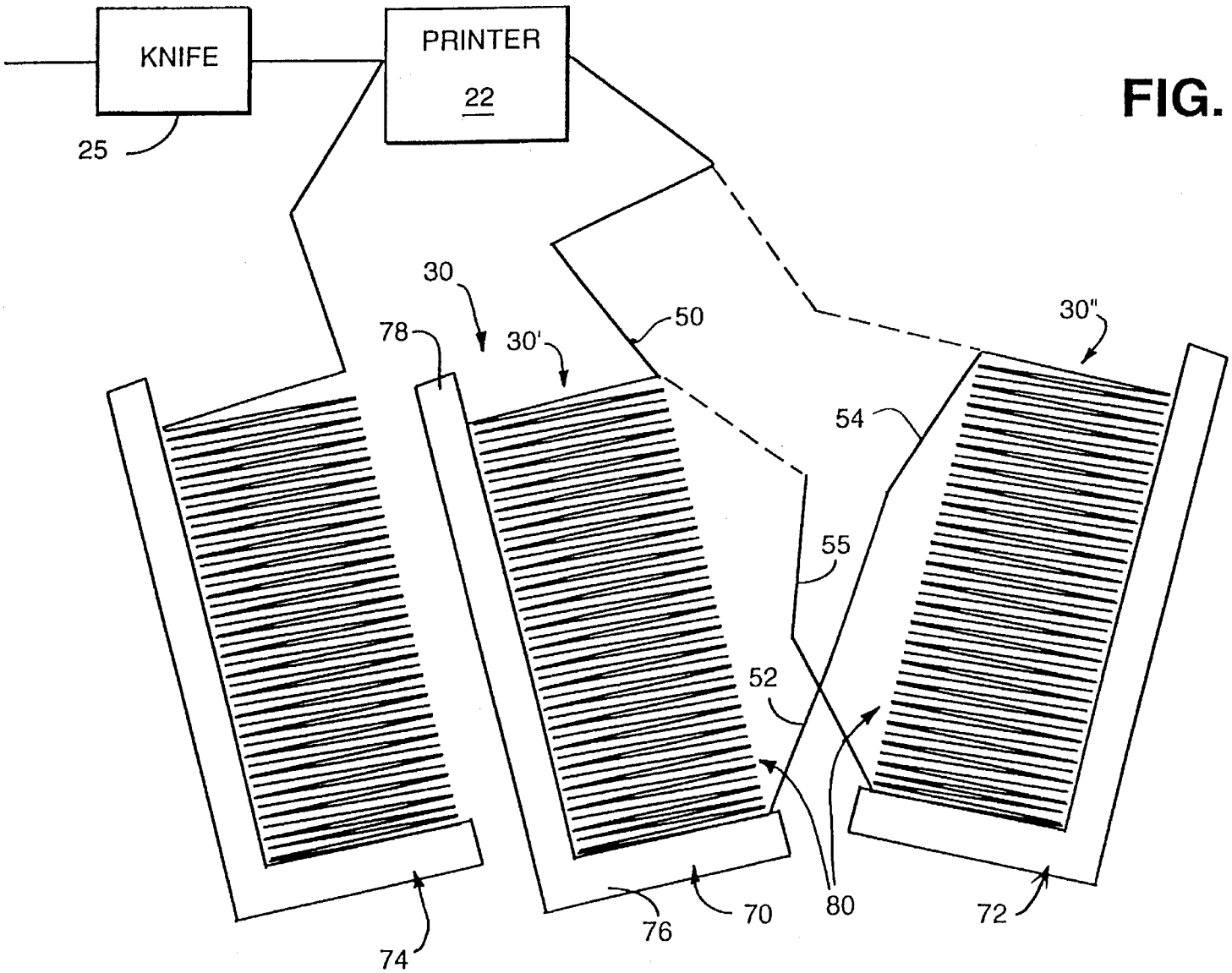
FIG. 2 is a side view illustrating a preferred arrangement of the input and output magazines for the paper supply system depicted in FIG. 1.

In accordance with the present invention, fan folded paper 30 is fed to the printer 22 from a paper supply 42 contained in a pedestal 40 of the gaming device's cabinet 20. The pedestal area 40 in which the paper supply 42 is contained may be opened to the upper area 43 in which the game controller 12 and/or printer 22 are contained as illustrated in FIG. 2. Alternatively, the pedestal area 40 containing the paper supply 42 may be separated from the game controller 12 and/or printer 22 by a wall 44 or the like as shown in FIG. 1 if it is desired to restrict access to the game controller 12 more than access to the paper supply 42 is restricted. In the latter embodiment, an opening 46 is formed in the separating wall 44 to allow paper from the supply 42 to be input to the paper input feed mechanism 24 of the printer 22. The opening 46 may be formed of a hole or slot in the wall 44 or the opening 46 may be formed of a labyrinthian type passageway 48 if extra security is desired. The labyrinthian passageway deters access for tampering with the game controller and the like through the opening 46.

As shown in FIG. 1, the paper supply 42 includes one or more input magazines 32, 34, 36 and 38 for holding the fan folded paper 30 to be input to the printer 22. Because fan folded paper 30 is fed to the printer 22 from outside of the housing of the printer 22, the amount of paper capable of being held in a single magazine is much greater than the amount of paper contained on a single roll mounted within the printer. Further, both the leading end 50 and trailing end 52 of the fan folded paper held in each magazine, such as the first magazine 32 are accessible by an operator. This allows the paper's leading end 50 to be input to the paper feed input mechanism 24 while the trailing end 52 of the paper in the magazine 32 is attached by means of tape 53 or the like to the leading end 54 of the paper held in a second magazine 34. The paper held in the second magazine 34 is thus automatically fed to the printer 22 after the paper in the first magazine 32 is depleted.

More particularly, in accordance with one embodiment of the present invention each input magazine 32, 34, 36 and 38 is provided with an opening 56 therein through which access to the trailing end of the paper supply held in the respective magazine may be had for attachment to the leading end of the paper supply in another magazine. As shown in FIG. 1, a leading end 50 of the paper supply 30' held in the magazine 32 is input to the printer's input feed mechanism 24 while the trailing end 52 of the paper supply 30' is attached by tape or other adhesive to the leading end 54 of the paper supply 30" held in the magazine 34. When the paper supply 30' held in the first magazine 32 is depleted, the paper from the paper supply 30" is automatically fed to the input feed mechanism of the printer 22, the paper from the magazine 34 being fed from a top opening of the magazine 34 through the opening 56 in the first magazine 32 up through the top opening of the magazine 32 to the input feed mechanism 24. In order to eliminate the need for the paper in the second magazine 34 to be fed to the printer 22 through the first magazine 32, various embodiments of the magazines may be employed. For example, instead of providing an opening 56 at the bottom of each of the magazines, the trailing end 52 of the paper in one magazine 32 may be pulled up through the magazine 32 adjacent an inner wall 60 of the magazine when the paper supply is installed. The trailing end 52 is then accessible from the top opening of the magazine 32 where it may easily be attached to the leading end 54 of the paper supply held in the second magazine. A preferred embodiment of the magazines is depicted in FIG. 2 however.

As shown in FIG. 2, each of the magazines 70, 72 and 74 has a floor 76 and a backwall 78 extending upwardly and generally perpendicular to the floor 76, the floor 76 and backwall 78 supporting the supply of fan folded paper 30. Each of the magazines has an open front area 80 wherein the input magazines 70 and 72 are positioned relative to each other so that the open front area 80 of the magazine 70 faces the open front area 80 of the magazine 72. In order to maintain the paper supply on the respective magazines 70, 72 and 74, the magazines are tilted so that the paper supply rests not only against the floor 76 but also against the backwall 78. The magazines 70, 72 and 74 may further be provided with sidewalls or small guides extending from the backwall 78 in a plane generally perpendicular to both the floor 76 and backwall 78 so as to prevent lateral movement of the paper supply in a direction parallel to the plane of the backwall 78. However, depending upon the positioning of the magazines 70 and 72 relative to one another and to the printer 22 such sidewalls or guides may not be needed. The input magazines 70 and 72 are positioned relative to one another such that the open front 80 of the magazine 70 faces the open front 80 of the magazine 72. The open fronts 80 of the magazines allow access to the trailing end 52 so that it may be attached to the leading end 54 of the paper supply supported on the magazine 72. Further, the open front 80 of each of the magazines allows the paper in the second magazine to be supplied to the printer directly therefrom when the paper in the first magazine is depleted without having to snake through the first magazine as in the embodiment depicted in FIG. 1.

More particularly, in order to supply paper to the printer 22 in accordance with the invention depicted in FIG. 2, paper supplies 30' and 30" are installed on empty magazines 70 and 72. The leading end 50 of the paper on one of the magazines 70 is input to the printer's input feed mechanism 24 whereas the trailing end 52 of the paper supply 30' is attached to the leading end 54 of the paper supply 30". When the paper supply 30' supported on the magazine 70 is depleted, the leading end of the paper supply 30" supported on the magazine 72 is automatically fed into the input feed mechanism 24 of the printer. While the printer 22 is being fed with fan folded paper from the supply 30" supported on the magazine 72, the operator at any time may insert a new paper supply on the magazine 70, connecting the leading end 50 of the new paper supply with the trailing end 55 of the paper supply 30" supported on the magazine 72. The time span when paper may be replenished in one magazine thus begins when that magazine's paper supply is depleted and the second paper supply begins to feed the printer, the time span ending when the second paper supply is depleted. Thus the window of opportunity for replenishment is as long as it takes to use one supply of paper held in a magazine. If the paper supplies held in a magazine are large enough, replenishment of the paper may be made to coincide with routine servicing of the gaming device so as to diminish the frequency of paper replenishment as well as to increase the flexibility of timing the paper replenishment.

The fan folded paper utilized with the paper supply system of the present invention may be single ply, double ply or formed into double ply paper. More particularly, if only a single printed record is desired, single ply fan folded paper may be utilized. If however two records of the same gaming information are desired, for example where one record is output from the gaming device to provide a winning ticket to the player and a second record with the same information is stored within the gaming device, double ply fan folded paper forming a single paper supply may be utilized. Alternatively, double ply fan folded paper may be formed by feeding single ply fan folded paper from two magazines synchronously. More particularly, if it is wished to form double ply fan folded paper from two supplies of single ply paper, two additional input magazines 36 and 38 are employed as shown in FIG. 1. The top ply of paper input to the printer 22 comes from the magazine 36 while the bottom ply of paper comes from the magazine 32, the paper from the magazines 32 and 36 being fed to the printer in synchrony to form a double ply paper for printing two records simultaneously. In this instance, the single ply paper in the paper supplies supported by the magazines 32 and 36 may have one surface thereof chemically treated as is well known so that two records of the gaming information may be printed simultaneously on two plies of paper with a single print head 26. Further, the bottom ply of paper in the magazine can be attached to bottom ply paper in the magazine 34 and the top ply of paper in the magazine 36 can be attached to the top ply paper in the magazine 38 to increase the available paper supply as discussed above.

Many modifications and variations of the present invention are possible in light of the above teachings. Thus, it is to be understood that, within the scope of the appended claims, the invention may be practiced otherwise than as described herein above.

What is claimed and desired to be secured by Letters Patent is:

1. A gaming device comprising:

a controller for controlling the operation of said gaming device;

a printer for recording events on paper in response to said controller;

a plurality of supplies of fan folded paper, each supply of fan folded paper having a leading end and trailing end;

a first magazine for holding a supply of fan folded paper; and a second magazine for holding a supply of fan folded paper, each of said first and second magazine including a floor, a backwall extending upwardly from said floor, and an open front area opposite said backwall, said open front area extending at least substantially the same length as said backwall and parallel to said backwall, said first and second magazines being positioned relative to each other such that the open front area in said first magazine faces the open front area in said second magazine, the leading end of the fan folded paper held in said first magazine being input to said printer and the trailing end of the fan folded paper held in said first magazine being attachable to the leading end of the fan folded paper held in said second magazine so that when paper is said first magazine is depleted, the paper held in said second magazine is automatically input to said printer.

2. A gaming device as recited in claim 1 wherein said first and second magazines are tilted in opposite directions such that the paper in each of said magazines rests on both the backwall and floor of a respective magazine.

3. A gaming device as recited in claim 1 wherein said gamming device has a housing with a first compartment and a second compartment separated from said first compartment, said first compartment storing said controller and said second compartment storing said plurality of paper magazines.

4. A gaming device as recited in claim 3 wherein said housing includes a wall for separating said first and second compartments, said wall having a passageway therein to allow paper from a magazine to pass through to said printer, the printer being contained in said first compartment.

5. A gaming device as recited in claim 4 wherein said passageway has a nonlinear shape to inhibit access to said first compartment from said second compartment through said passageway.

6. A gaming device comprising:

a cabinet having a wall that divides said cabinet into a first compartment and second compartment and restricts physical access between said compartments, said wall having a passageway therein to allow paper to pass between said compartments:

a controller adapted to control the operations of said gaming device, said controller being positioned in said first compartment;

a printer adapted to receive paper and record events on the paper in response to said controller, said printer being positioned in said first compartment;

a first supply of fan folded paper having a leading end and a trailing end, the leading end being input to said printer; and a first magazine for holding said first supply of fan folded paper, said first magazine being positioned in said second compartment;

a second supply of fan folded paper having a leading end and a trailing end;

a second magazine for holding said second supply of fan folded paper, said second magazine being positioned in said second compartment, the trailing end of the paper in the first magazine being attachable to the leading end of the paper held in said second magazine so that when paper in said first magazine is depleted, the paper in said second magazine is automatically input to said printer;

wherein each of said first and second magazines includes a floor, a backwall extending from said floor, and a frontwall disposed opposite said backwall, said frontwall including a slot which permits the trailing end of the paper in said first magazine to be attached to the leading end of the paper in said second magazine.

* * * * *